United States Patent [19]

Neuhierl

[11] 4,364,566

[45] Dec. 21, 1982

[54] GAME APPARATUS WITH TOY VEHICLES

[76] Inventor: Hermann Neuhierl, Waldstrasse 36, D-851 Fürth/Bayern, Fed. Rep. of Germany

[21] Appl. No.: 191,027

[22] Filed: Sep. 26, 1980

[30] Foreign Application Priority Data

Sep. 29, 1979 [DE] Fed. Rep. of Germany ..... 2939703

[51] Int. Cl.[3] ..... A63F 9/14

[52] U.S. Cl. ..... 273/86 B; 46/1 K

[58] Field of Search ..... 273/86 R, 86 B; 46/1 K; 104/60, 295, 304, 305

[56] References Cited

U.S. PATENT DOCUMENTS

| | | | |
|---|---|---|---|
| 3,227,825 | 1/1968 | Pullen | 273/86 B UX |
| 3,367,657 | 2/1968 | Cobbenhagen et al. | 273/86 B |
| 3,572,711 | 3/1971 | Conklin et al. | 273/86 B |
| 4,247,107 | 1/1981 | Smith et al. | 273/86 B |

FOREIGN PATENT DOCUMENTS

| | | | |
|---|---|---|---|
| 2719666 | 11/1978 | Fed. Rep. of Germany | 273/86 B |
| 2833159 | 2/1980 | Fed. Rep. of Germany | 46/1 K |

*Primary Examiner*—Anton O. Oechsle

*Attorney, Agent, or Firm*—Scully, Scott, Murphy & Presser

[57] ABSTRACT

A toy or game apparatus with toy vehicles, having a track in which there are located contact elements for the electrical recognition of individual vehicles and in which the toy vehicles are provided with bridging contacts. The apparatus serves to prescribe predetermined driving rules for the vehicles traversing the track. The driving rules variously take the form of driving within set speed limits over a portion of the track, avoiding obstacles, staying on the left or right side of the track over a portion thereof, etc. Circuitry is provided for the assessing of penalty points to the vehicles when they fail to abide by a prescribed driving rule.

24 Claims, 20 Drawing Figures

GAME APPARATUS WITH TOY VEHICLES

BACKGROUND OF THE INVENTION

1. Field of the Invention

The present invention relates to a toy or game apparatus with toy vehicles, and having a track in which there are located contact elements for the electrical recognition of individual vehicles and in which the toy vehicles are provided with bridging contacts. Game apparatuses of this type are particularly known as auto race tracks.

Since in auto racetracks of this type, races are preferably conducted among the players, apparatuses have already been previously constructed which can retain and display the results during racing. In particular this relates to the number of the covered laps. Accordingly, lap counters have been employed for a long time in connection with auto race tracks.

2. Discussion of the Prior Art

Also the running time has been considered in arrangements of that type in conjunction with the lap count, for example, in a device constructed pursuant to German Pat. No. 1703878. Set therein can be a predetermined number of laps which are to be covered. At the passing of the first vehicle towards the first lap, there is now started a timeclock. It is possible to read off the number of laps of the participating vehicle during the course of the race. As soon as the first vehicle has covered the previously set number of laps, there is then switched off the current for the entire installation and the time is determined. Thus, it is possible that the racing drivers will always again cover a predetermined number of laps over a predetermined track or course, and to read off the time required therefor. The advances of the players in the running, accordingly, can be well controlled.

It is also possible to monitor the start of the race, for instance, with an apparatus pursuant to German Laid-open Patent Application No. 2 035 478. Therein, the movement of a starter figure is combined with an electrical switch which switches in the current for all participating vehicles. Premature starts are thereby precluded.

For more recent developments in auto race tracks, for example, pursuant to German Patent Application No. 27 22 734.5, which facilitate not only an influence over the speed but also a steering, there have been created suitable recording arrangements. In German Patent Application No. 28 25 308 there is proposed an arrangement in which the numbers of laps are held fixed independently as to whether the vehicle utilizes the right or the left side of the track.

Electronic apparatuses, for example, such as in German Patent Application No. 28 33 159, facilitate a still more extensive recording of the racing cycle. It is possible to not only maintain the number of laps but also the speed, the highest speed for each lap or the shortest time for each lap. As an advance function for the racing course it is possible to not only predetermine a definite number of laps but also a predeterminate time.

Within the scope or framework of the described arrangements it is possible to satisfactorily retain the racing conditions in all phases.

SUMMARY OF THE INVENTION

Accordingly, it is a primary object of the present invention to provide arrangements of the type described with which it is possible to achieve functions beyond the maintenance of the race course or conditions.

The foregoing is to be designated, as is known,as a "passive" apparatus. Created within the scope of the present invention is now an "active" apparatus which directly engages into the racing conditions in a multiple art and manner.

The invention is also adapted to prescribe predetermined playing rules for the racing course or cycle and to automatically observe the adherence thereto. Hereby, the player can at all times determine without difficulty which rules he must maintain and with what number of driving errors he has been charged.

Pursuant to the invention, for the recording of the individual driving movements, as well as the summated recording of the points position for the "driving errors" of the individual vehicles, there are employed electronic means or a combination of electronic and mechanical means. This embodiment can be effectuated in different ways within the scope of the invention.

As examples of the driving requirements which are to be fulfilled within the framework of the racing or street traffic, the invention deals herein with speed limits, prohibitions on passing on the right or left side of the roadway, traversing a slalom course, avoidance of obstacles, and detours.

Driving restrictions of that type are encountered not only in street traffic but also during racing, for instance at the start of the "Indianapolis", during heavy rain, when oil is present on the track or when a disabled vehicle must be bypassed.

The presetting of these driving conditions can be carried out in different ways and manners.

In one embodiment this is effected through the intermediary of a control panel with switches. The present driving requirements or demands are switched in or switched out through actuation of the associated switches. At the switching in there will be concurrently illuminated the associated signs in the control panel and in a sign bridge which extends over the track. Recording locations are arranged in the associated track section which will record a predetermined vehicle during the driving thereover. When this recording is effected on a forbidden side of the track, then the vehicle receives penalty points since the respective electronic switch will recognize the recording location as being closed for this driving requirement.

On the same side of the track there is found a second combination of recording locations. Also in this instance will the vehicle be again recorded while traveling through. If a speed limit is in effect then the time intervals between the first and second recording of the vehicle is electronically fixed and compared with a predetermined time which corresponds to the speed limit. When the first-mentioned time is shorter, then the vehicle is considered to have driven faster over this track section than prescribed and again receives penalty points.

In the preceding embodiment the corresponding stages of difficulties can be switched in or switched off by the drivers themselves or a person acting as a judge. This will provide for an extremely variable racing sequence.

A further embodiment facilitates the switching about of the respective driving requirements in an electromechanical manner. Utilized for this purpose is a stepping mechanism in which contacts are actuated through cams. These contacts are present in lieu of the manually operable control panel.

It is an aspect of the invention that the individual cams can be rotated or offset relative to each other. It is also possible to construct an individual cam of two or more individual segments so as to be able to also influence the switching interval.

This arrangement facilitates the combination of a predetermined sequence for the switching in and switching out of the prescribed driving conditions. An additional variant is provided through the operation of the drive motor for the switching roller at different voltage values so that the timewise sequence can be either extended or shortened.

The switching in and switching out process can also be effected through an electronic recording or registration device. Printed therein is the appropriate symbol for the driving requirement and introduced is the desired time for the effectiveness thereof.

Within the scope of the present invention the switching in and switching out, is accordingly, afforded through three different methods. The simplest and least expensive embodiment is the illustrated form of a hand-operated apparatus. A further possibility is the replacement of this hand-operated apparatus by a stepping mechanism, or the combination of the hand-operated apparatus with a stepping mechanism.

The switching in and switching out, as illustrated, is effectuated through switching cams, wherein the switching cams not only determine the timewise sequence of the switching in and switching out processes but, to a predetermined extent, themselves determine the duration thereof. The third possibility, as indicated, is an electronic apparatus which facilitates a completely free selection for the timewise sequence of a race.

The present apparatus can be interconnected with an impulse track section. Further expansion possibilities are afforded by branch lines of the track where the vehicles are recorded ahead of and behind a branch line. One of the above described switching mechanisms sets forth the respective condition that vehicles must deviate towards the right or left. Thusly, when a vehicle is recorded which does not follow this driving rule it will once again receive penalty points.

Suitably, a sign bridge is provided for the display of the driving rules or demands. The drivers can orient themselves through the bridge since the presently effective driving rules are rendered visible through an illumination of the sign.

However, there can also be provided other instructions. For example, by means of a figure with a flag whereby the former will raise or lower the arm thereof with the flag, or through a traffic light. The traffic light will validate a driving direction. If a vehicle is present in a validated drive section, then the vehicle in the not validated section cannot turn in ahead of the other vehicle onto the main track. A timewise recording ahead of the authorized vehicle will again represent penalty points.

In the case of track narrowings or constricting this, as indicated, can be represented through a suitable sign so that the drivers will know that one side of the track is closed. The switching in of a sign of that type can also be connected with a mechanism in which, through the opening of a door, stones or styrofoam particles will fall onto the track.

BRIEF DESCRIPTION OF THE DRAWINGS

Reference may now be had to the following detailed description of preferred embodiments of the invention, taken in conjunction with the accompanying drawings; in which.

DETAILED DESCRIPTION

Figure 1A:
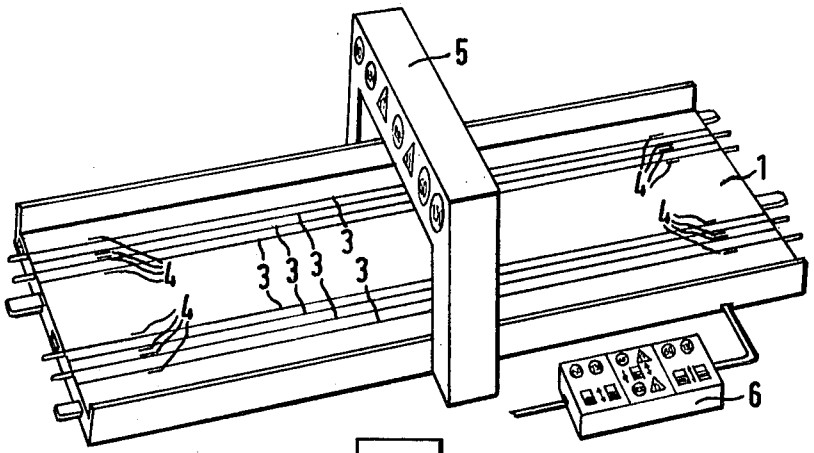
FIGS. 1 through 4 illustrate a track section which includes a sign bridge, a switching apparatus with a control panel and display.
Figure 1B:
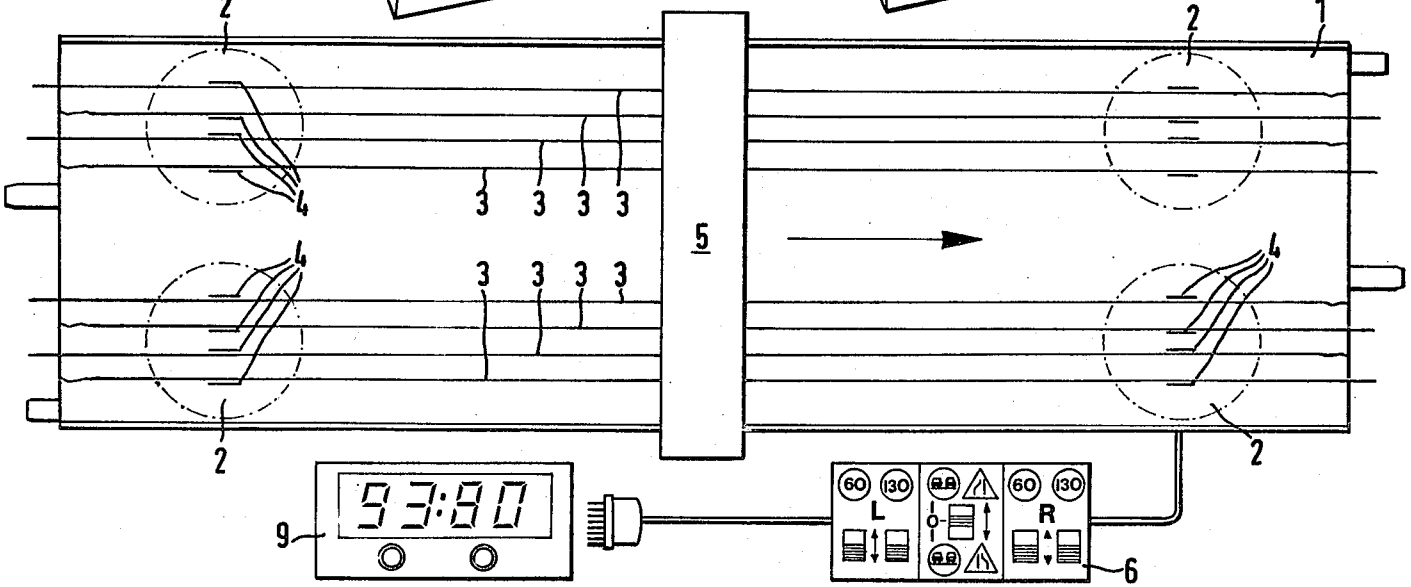

According to FIG. 1, contact segments 2 are provided in the track section 1. Contact elements 4 are provided so as to extend in parallel with the current rails 3, through which there is triggered an impulse at the traveling over of a vehicle. In the embodiment pursuant to FIGS. 1 through 4 there are presently arranged four contact segments 4 on the track section. Thus, the vehicle, insofar as it is not steered over, is detected twice on each track side. In embodiment 3 there are provided three contact segments. Provided herein is that the vehicle is always detected at the contact segments. It can be determined if the detection of the vehicle is obligatory, or the avoidance of traveling over the contact locations. The vehicles are forced to travel a slalom course as would be during a sporting event.

Figure 2:
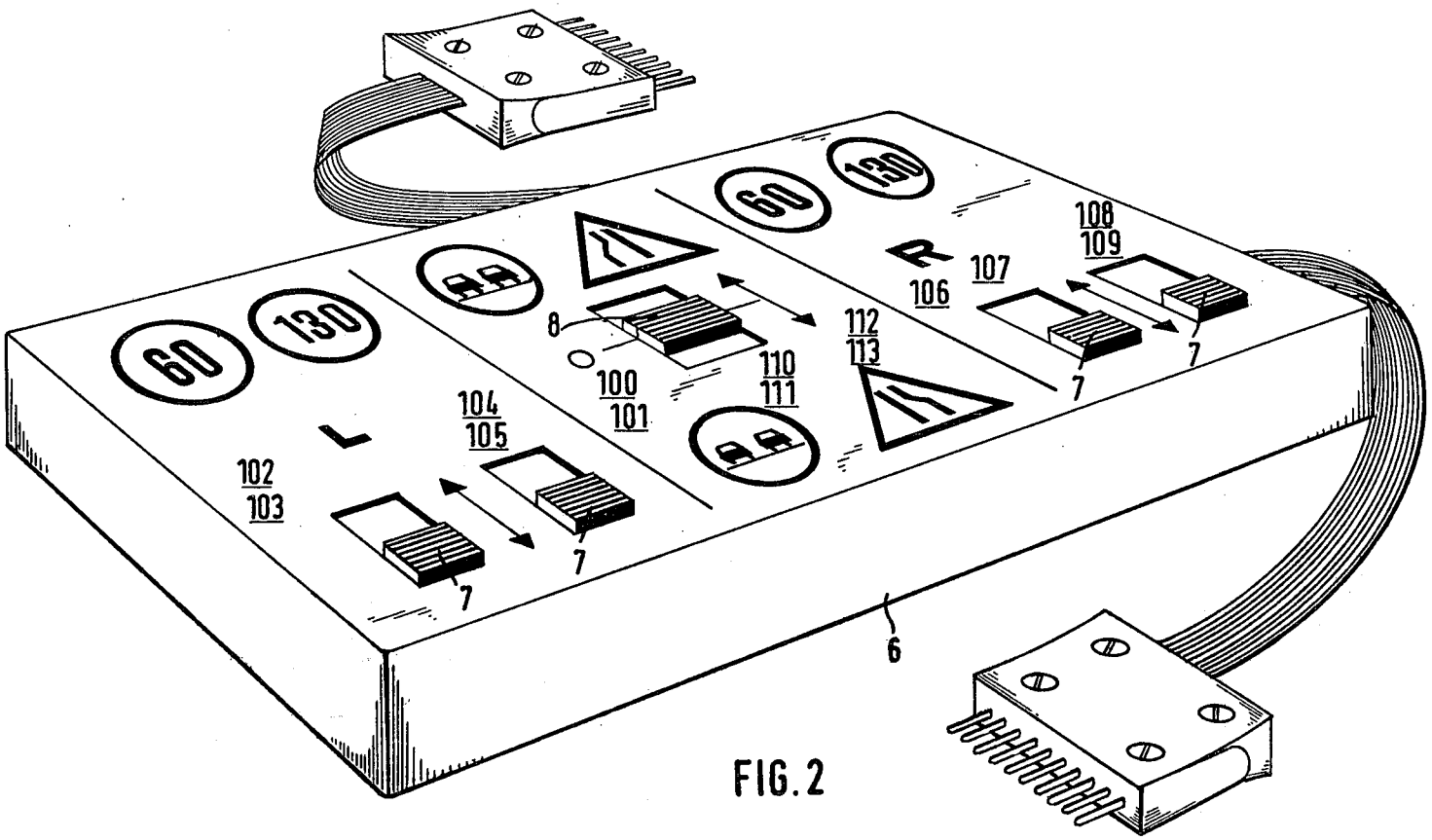
Figure 3:
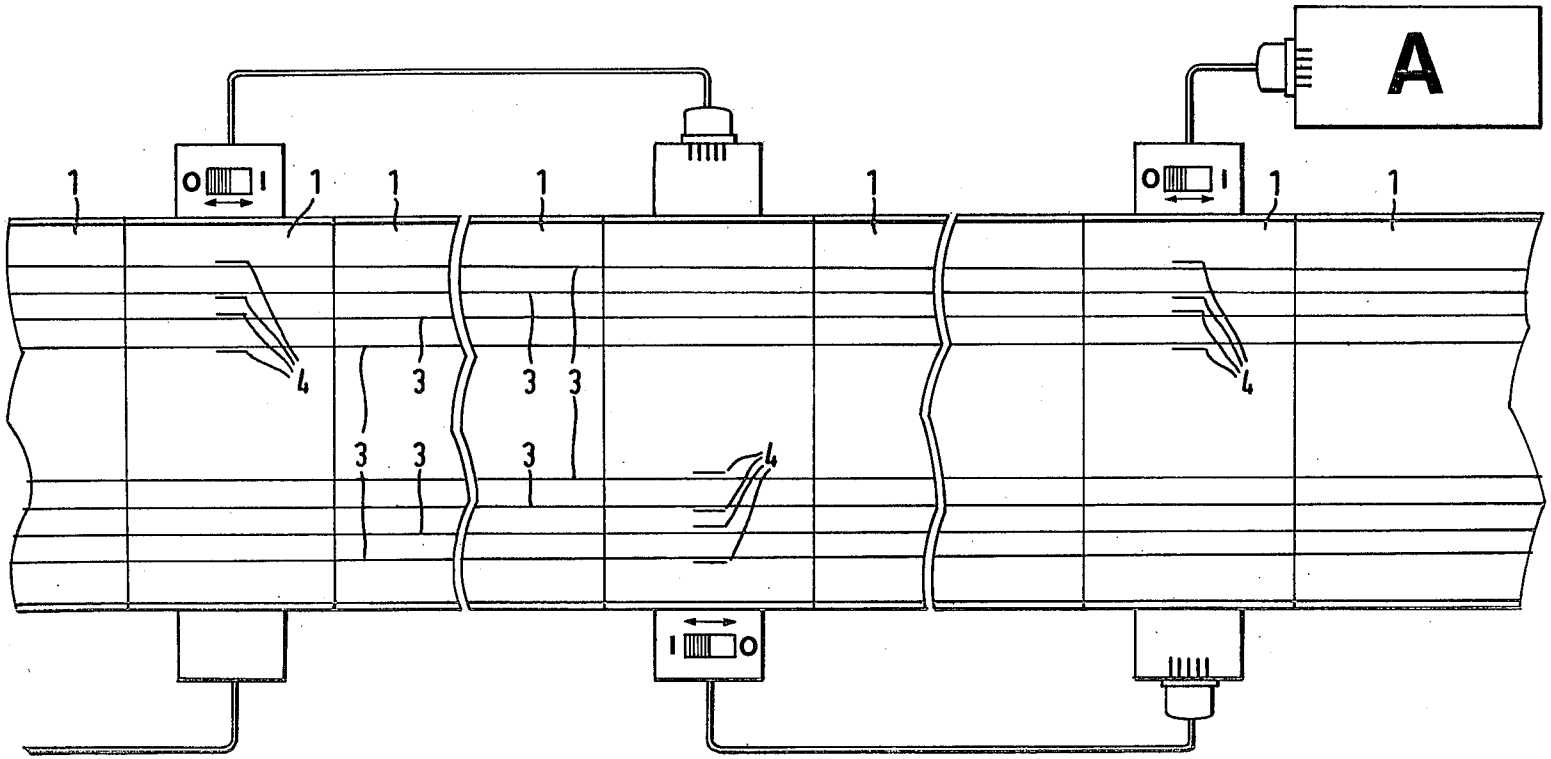

In FIG. 1 there is also illustrated the sign bridge 5. Arranged at its front surface are the respective signs which prescribe a predetermined behavior during traffic or during racing. This relates to the speed limitations or the maintaining of a predetermined side of the track. Other requirements or rules are illustrated still further herein. The sign bridge is preferably also electrically connected so that the corresponding sign is illuminated for a predetermined traffic rule. Thus, the players will know which rules are currently in force. Also illustrated in FIGS. 1 and 2 is a switching apparatus with a control panel and display 6. On the display there are shown the corresponding symbols, for example, speed limits, prohibitions on passing with a constricted location, which can be switched in and switched off through push buttons 7 and 8. At the switching in of a predetermined traffic requirement, the sign associated with the push button will illuminate since there is concurrently connected in a light-bulb or a luminescent diode.

Figure 19:
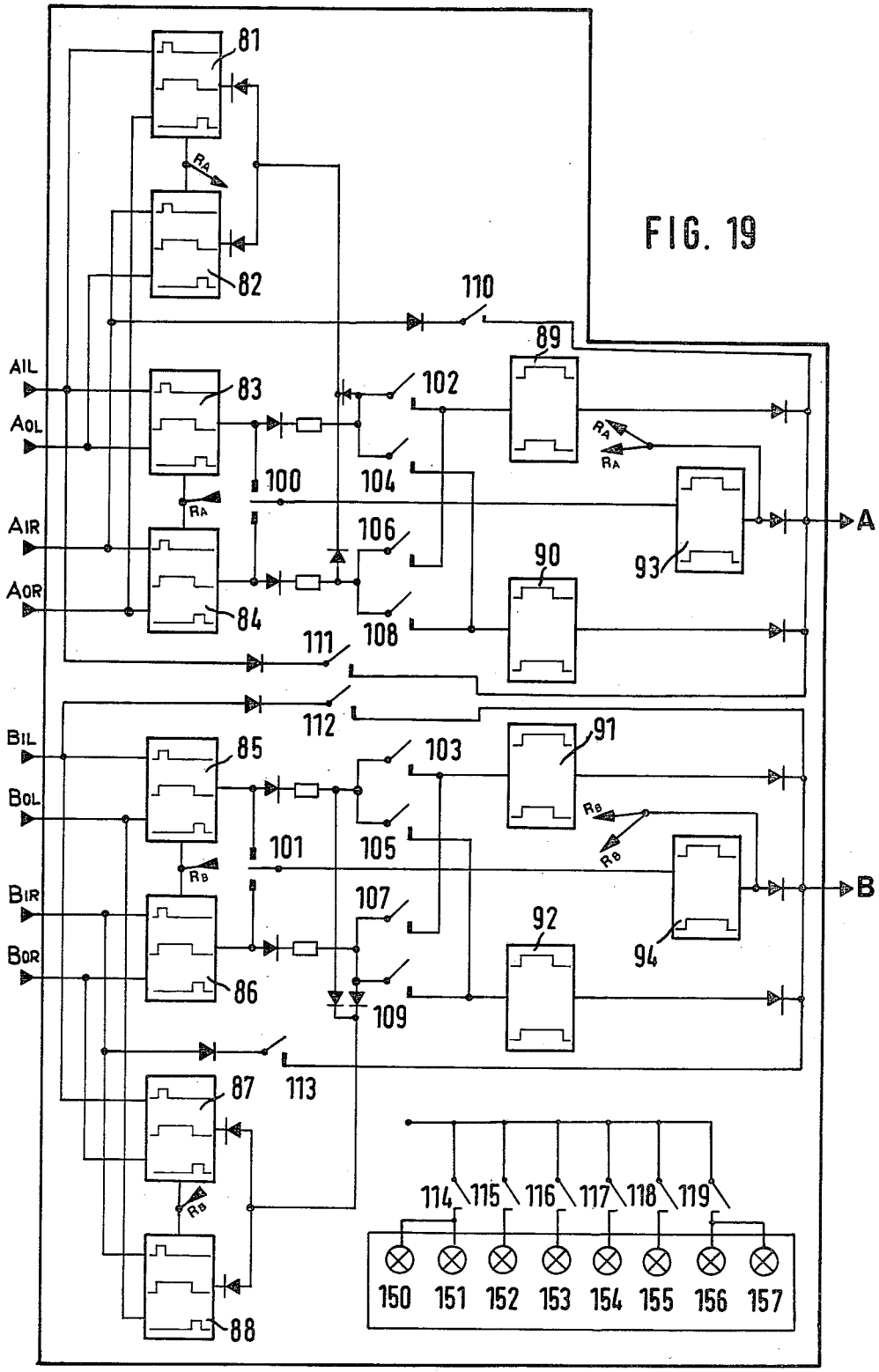
FIG. 19 illustrates a circuit diagram.

The numerals 100 through 113 which are referred to adjacent the operating button of the switching apparatus of FIG. 2 correspond to elements in FIG. 19. By means of the herein illustrated switching apparatus with the operating panel and display there are manually switched in and switched out predetermined traffic rules or conditions. Those participating in the race can thus themselves, or through another person, switch in or again switch off the restrictions.

Illustrated also in FIG. 1 is the display 9. This displays the amount of penalty points for each of the two participants in the race.

Figure 4:
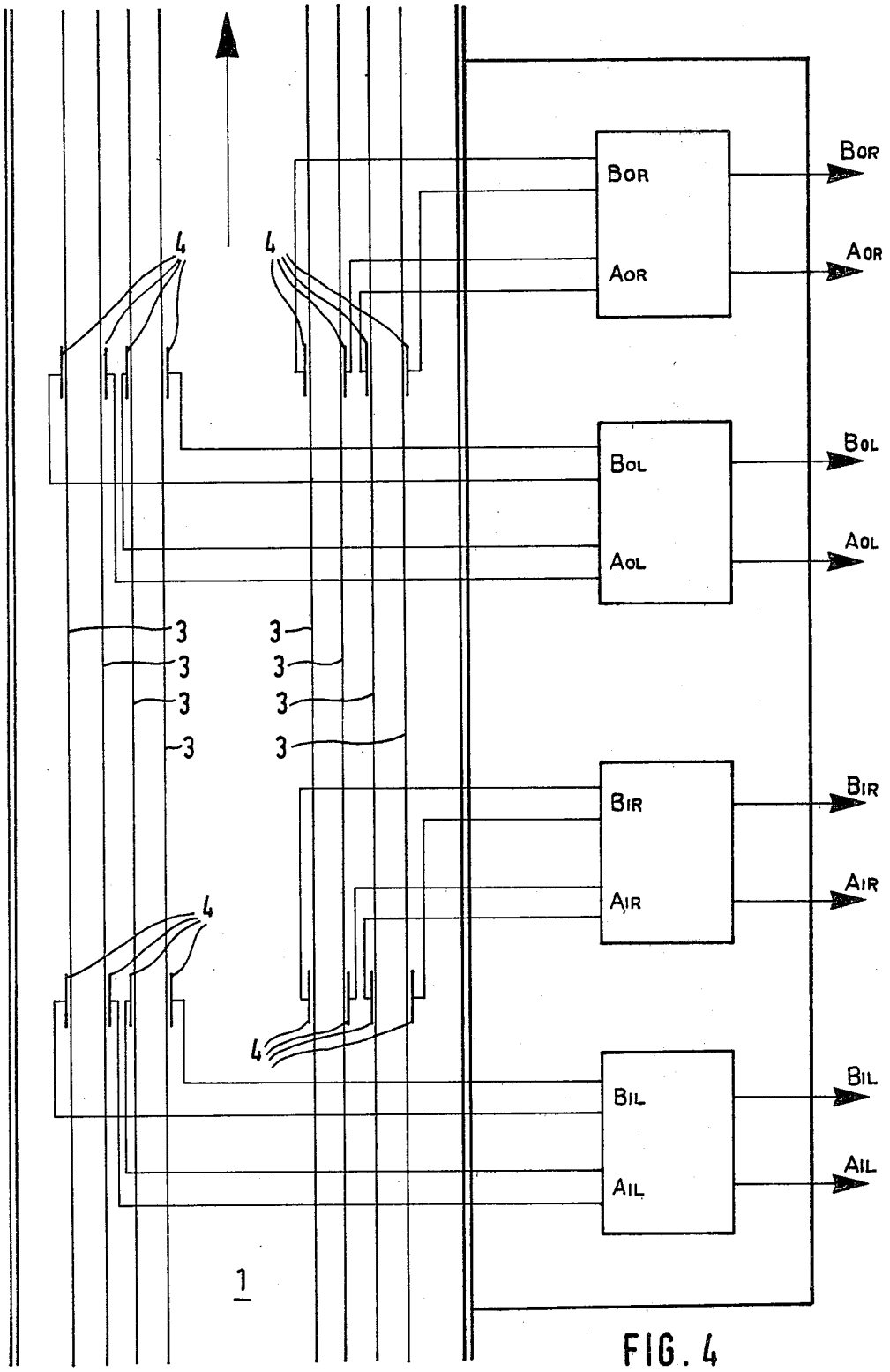
Figure 5:
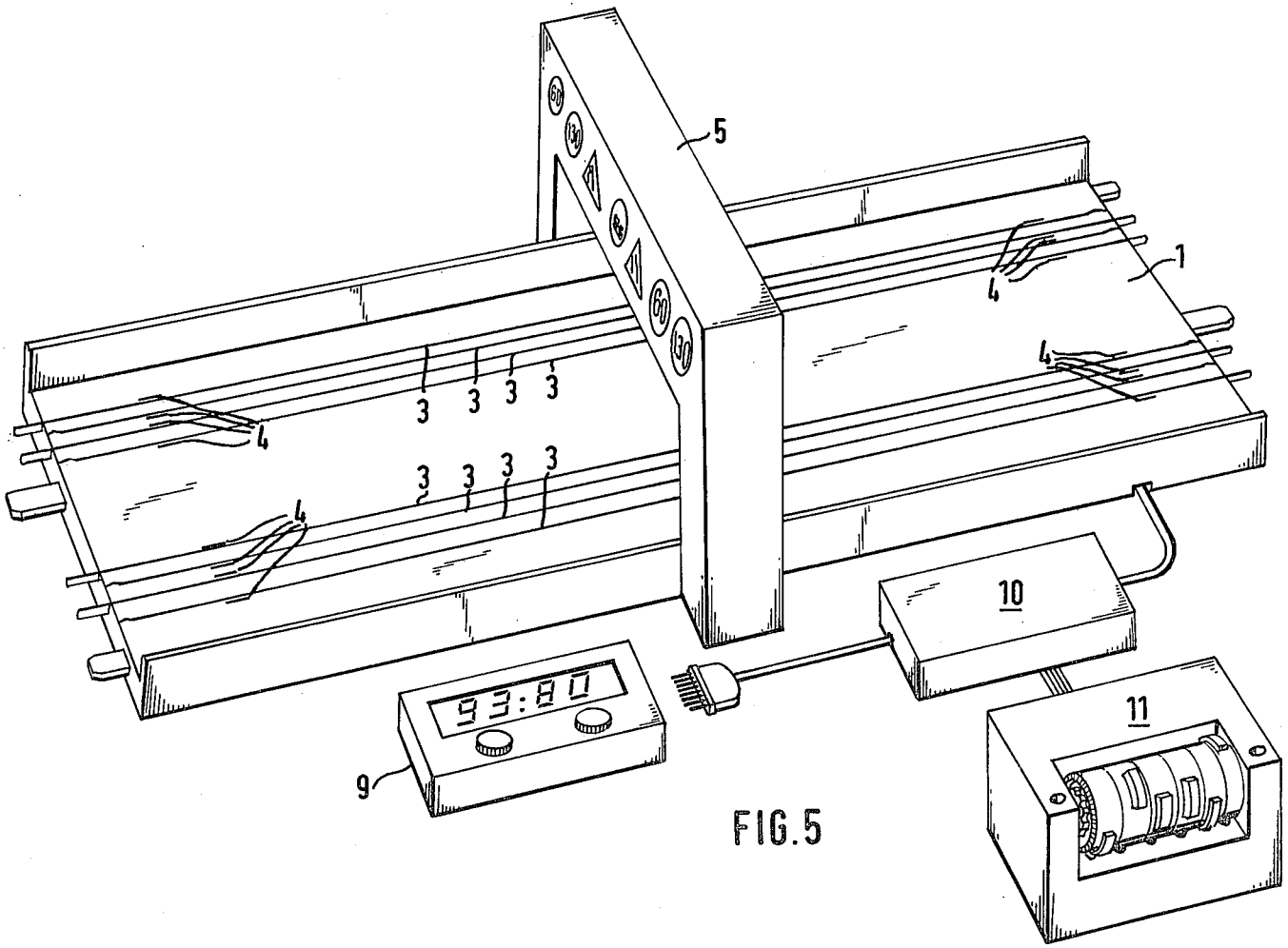
FIGS. 5 through 9 illustrate a switching apparatus, a stepping mechanism and display.
Figure 6:
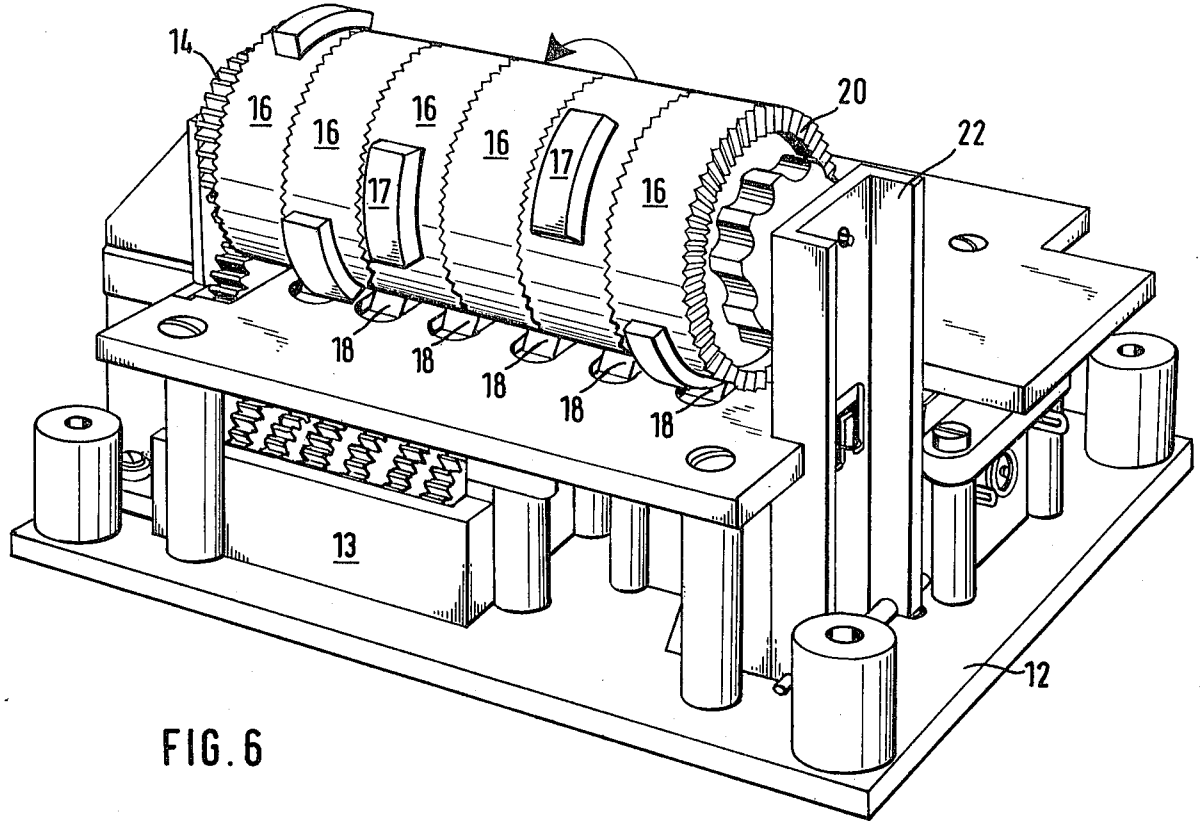
Figure 7:
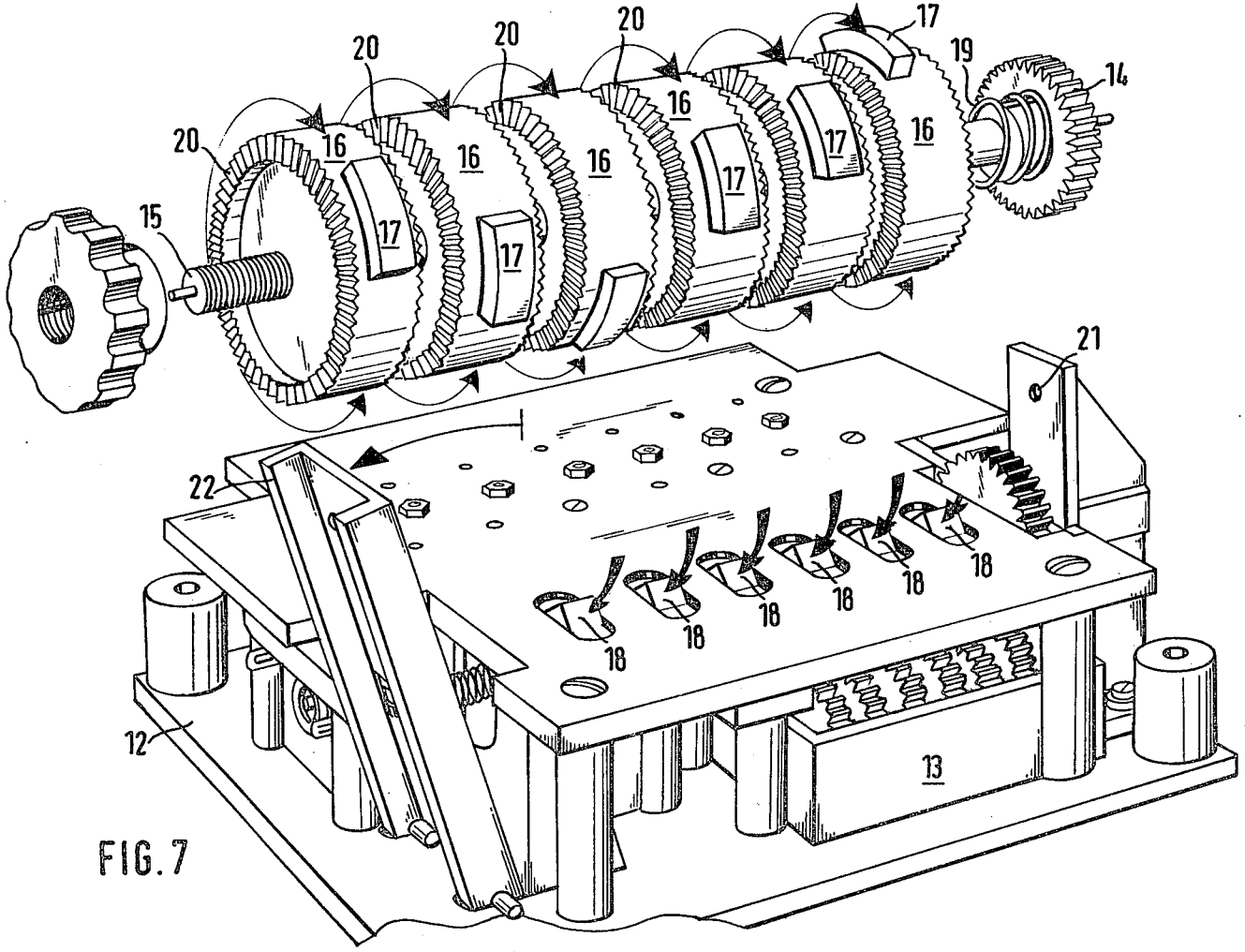

In FIG. 5 the switching apparatus 10 is arranged in an independent housing. The track section 1, the contact elements 4 and the sign bridge 5 conform to the arrangement according to FIGS. 1 through 5. Also the display 9 is utilized in the same manner. However, in this embodiment the switching in and switching out of the driving conditions is provided through the stepping mechanism 11. According to FIGS. 6 through 9, the drive 13 is located on a base plate 12, and which is driven by an electric motor. Thus, through a gear 14 there is driven an axle 15. Arranged on the latter are cam disks 16 with switch cams 17. The switch cams 17 act on contacts 18. The switch cams 16 are pressed together through a spiral spring 19 and are mutually retained by a toothing 20. An adjustment by hand is provided to overcome the sprial spring 19 so as to influence the timewise direction of the actuation of the contacts 18. The entire arrangement of the switching cams can be inserted whereby the axle 15 is introduced into the support bearing 21. Finally, the complementary support bearing 22 is pivoted in and comes into latching engagement.

Figure 8:
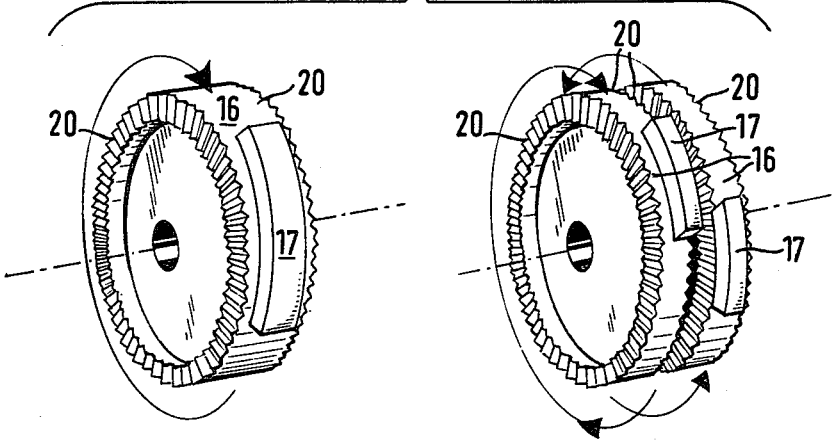

According to FIG. 8, a cam is constructed of at least two or even more individual components. A displacement of the cam range facilitates an extension of the switching time to double or more, or the introduction of two switching sequences within the framework of one rotation of the axle 15.

Figure 10:
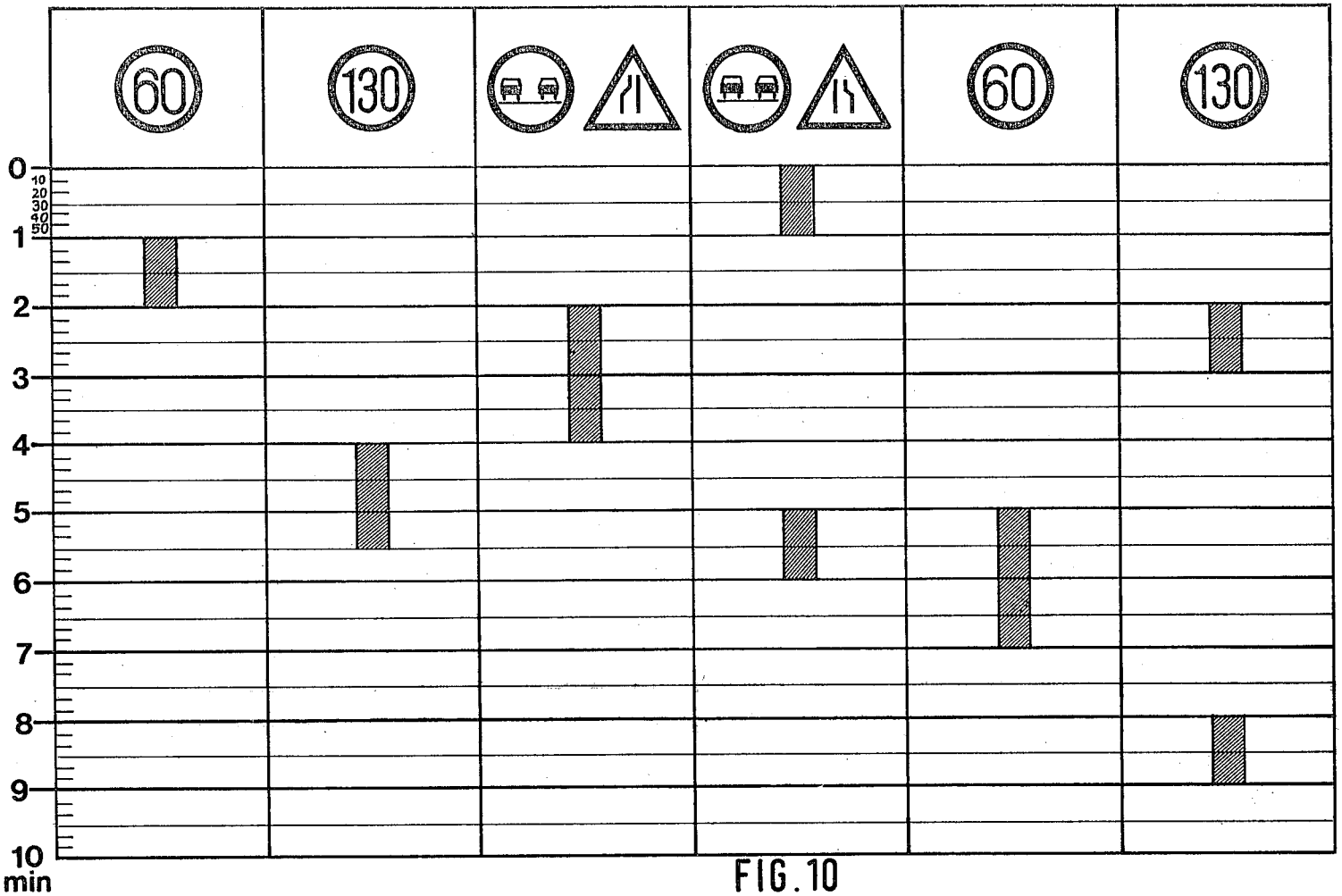
FIG. 10 illustrates a time plot.

FIG. 10 illustrates a time plot which assumes the time for a revolution of about 360° to be ten minutes. The basic time measure can be varied through an increase or reduction in the voltage by means of which there is driven the drive motor.

In FIG. 10 it is further assumed that the switching period for a switching cam 17 consists of one minute. When utilizing a cam disk formed of two individual components pursuant to FIG. 8 right, the switching period can accordingly consist of one to two minutes, as is described in the three first columns in FIG. 10. When the two parts of the cam disk are still more extensively rotated towards each other, then there are triggered two switching sequences during one minute, pursuant to column 4 and column 6 in FIG. 10.

Figure 9:
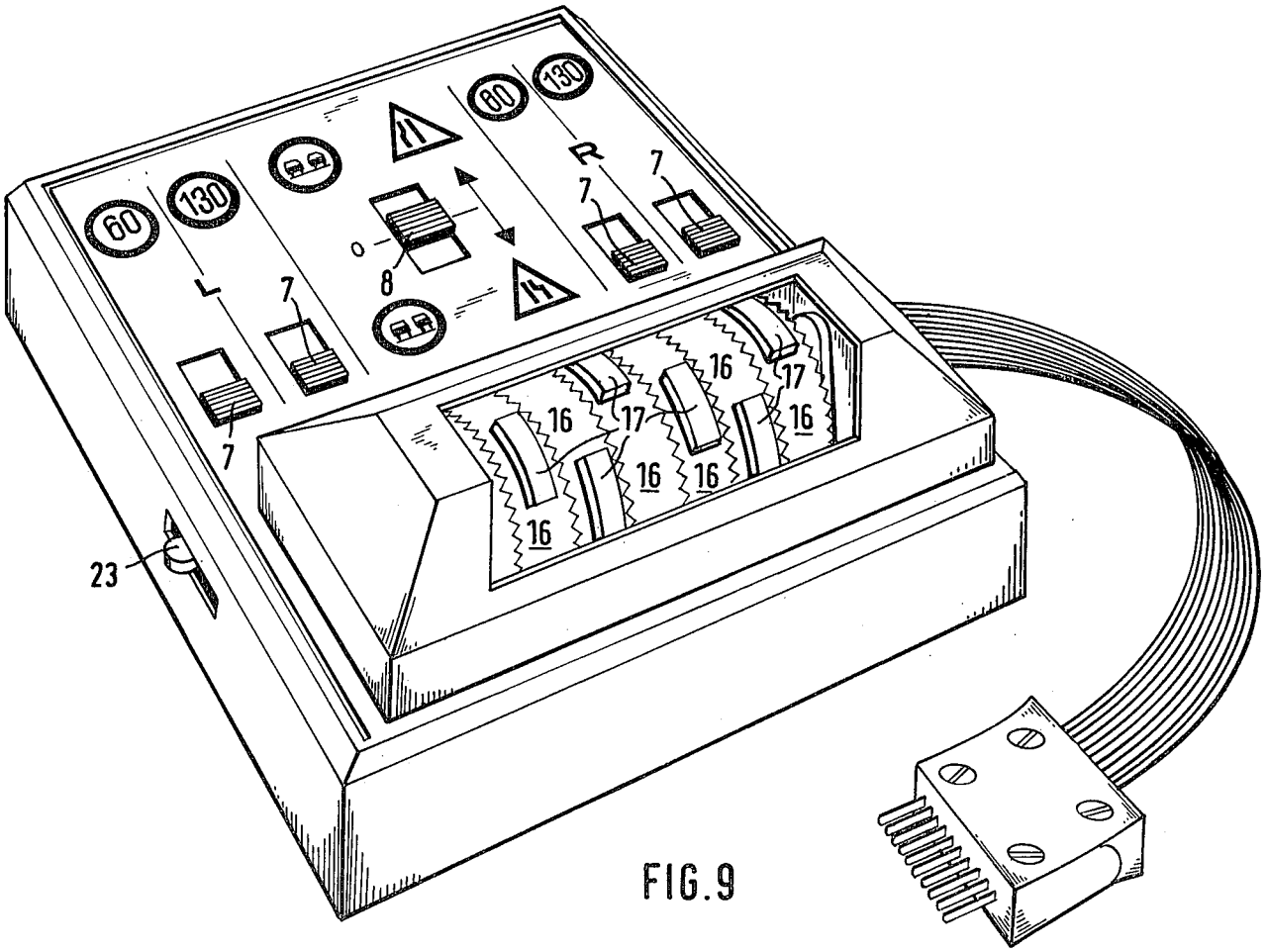

FIG. 9 illustrates a combination of the stepping mechanism 11 including the switching apparatus with the operating panel and display 6. The switching, in this instance, can be selectively effected manually, or mechanically through the stepping mechanism. At the switching in of the switch 23 there is achieved that the switch roller will run, and a switching out sequence is effected with the push button 7. In this instance there is thus actuated the contact 18 through switch cams 17, however, the current flow is disrupted through the corresponding position of the push button 7. The push button 7, in this instance, acts on a selector switch.

Figure 11:
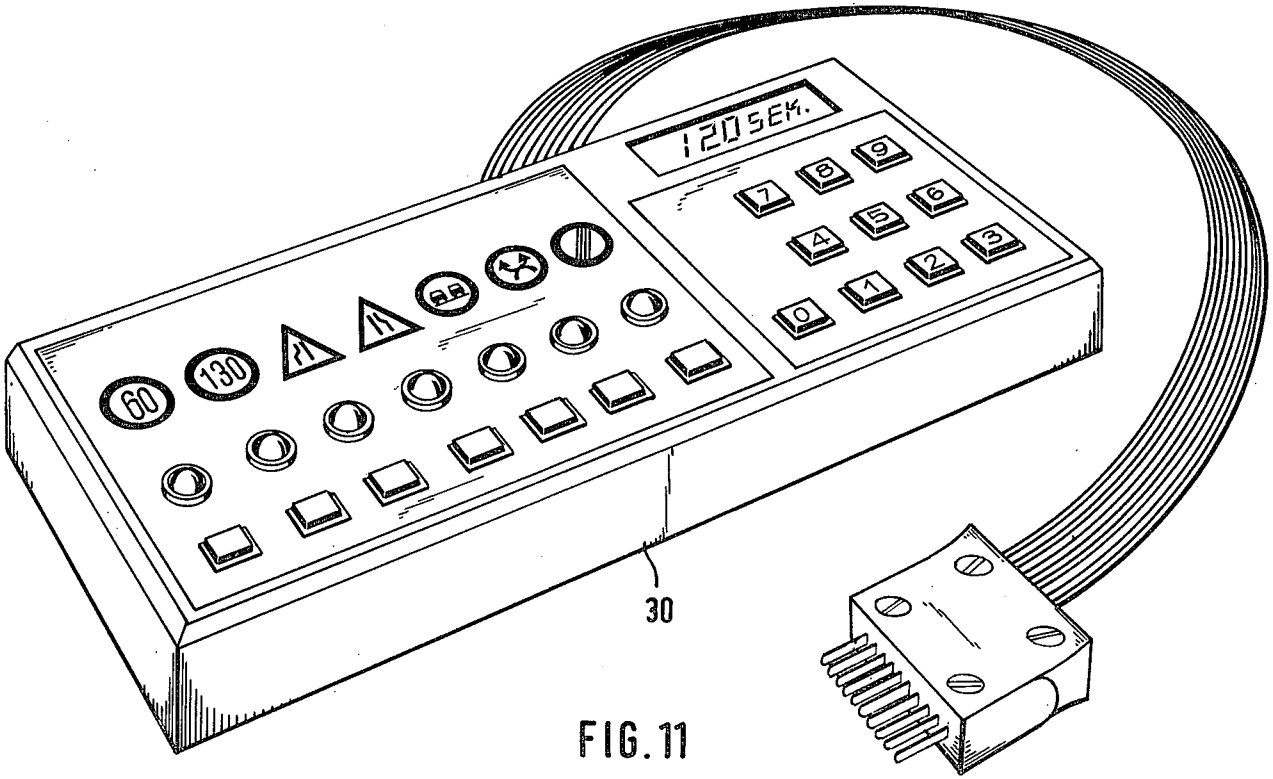
FIG. 11 illustrates an electronic input unit.

FIG. 11 illustrates an electronic input unit 13. The connection is effected pursuant to the illustration of FIG. 5 wherein, the stepping mechanism 11 is replaced by the electronic input unit 30. In this instance, the switching apparatus 10 is arranged independently of the electronic input unit within a separate housing. The electronic unit 30 is merely another embodiment of a switching apparatus used in the present invention. Instead of mechanically operating the switches 7 either manually (see element 6) or automatically (see element 11), an electronic switching unit 30 is provided which can be set. The switching apparatus 10 may, however, also be built into the housing of the electronic input unit 30. In both instances there must be provided a connecting capability for the display 9.

Figure 12:
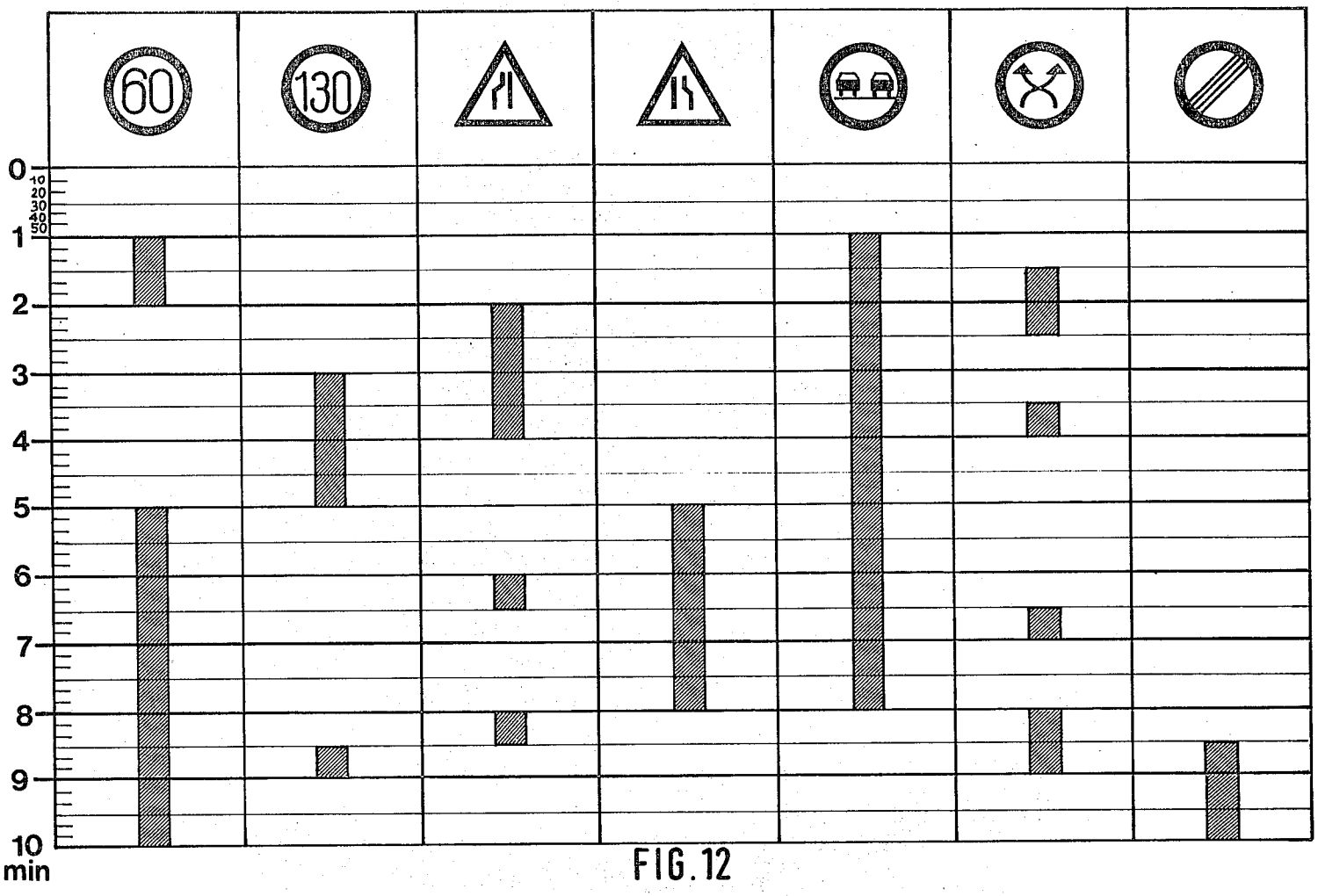
FIG. 12 illustrates a time plot.

In FIG. 12 there is illustrated an exemplary embodiment for a racing sequence which is preset with the electronic input unit 30. Thus, there can be preset driving requirements of suitable length and suitably frequent. At the input of a plurality of driving requirements or rules at the same point in time there is presently effected the time input up to the point in time at which there should occur a change. From this point on, based on desire, one or more push buttons may be newly depressed, for example, speed limits, prohibitions on passing, and so forth, so that the corresponding driving requirements can be switched in. It is also desirable in this case that when the switching in of the driving requirements there be illuminated a corresponding sign. Also the connection in of the sign bridge 5 is possible.

Figure 13:
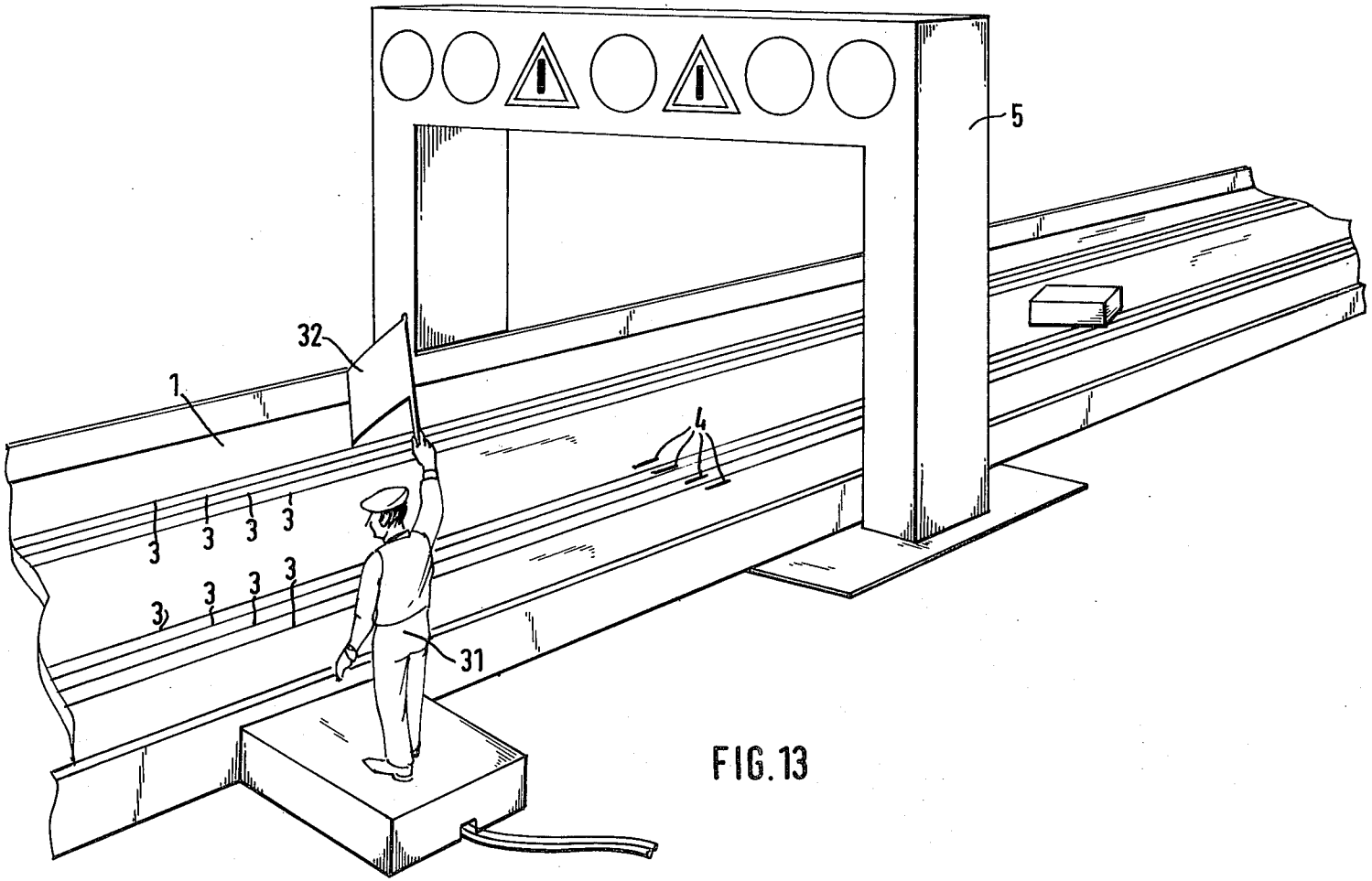
FIGS. 13 through 17 illustrate embodiments of further driving rules and the race display.

In FIG. 13 illustrates additionally to the sign bridge 5 a FIG. 31 with a flag 32. The flag with the arm is moved upwardly and downwardly through a mechanism. The movement of the flag is connected with the switching in and switching out of a driving requirement or rule. This flag movement activation is triggered in the same manner as, for example, the lighting of the symbols in the sign bridge 5.

Figure 14:
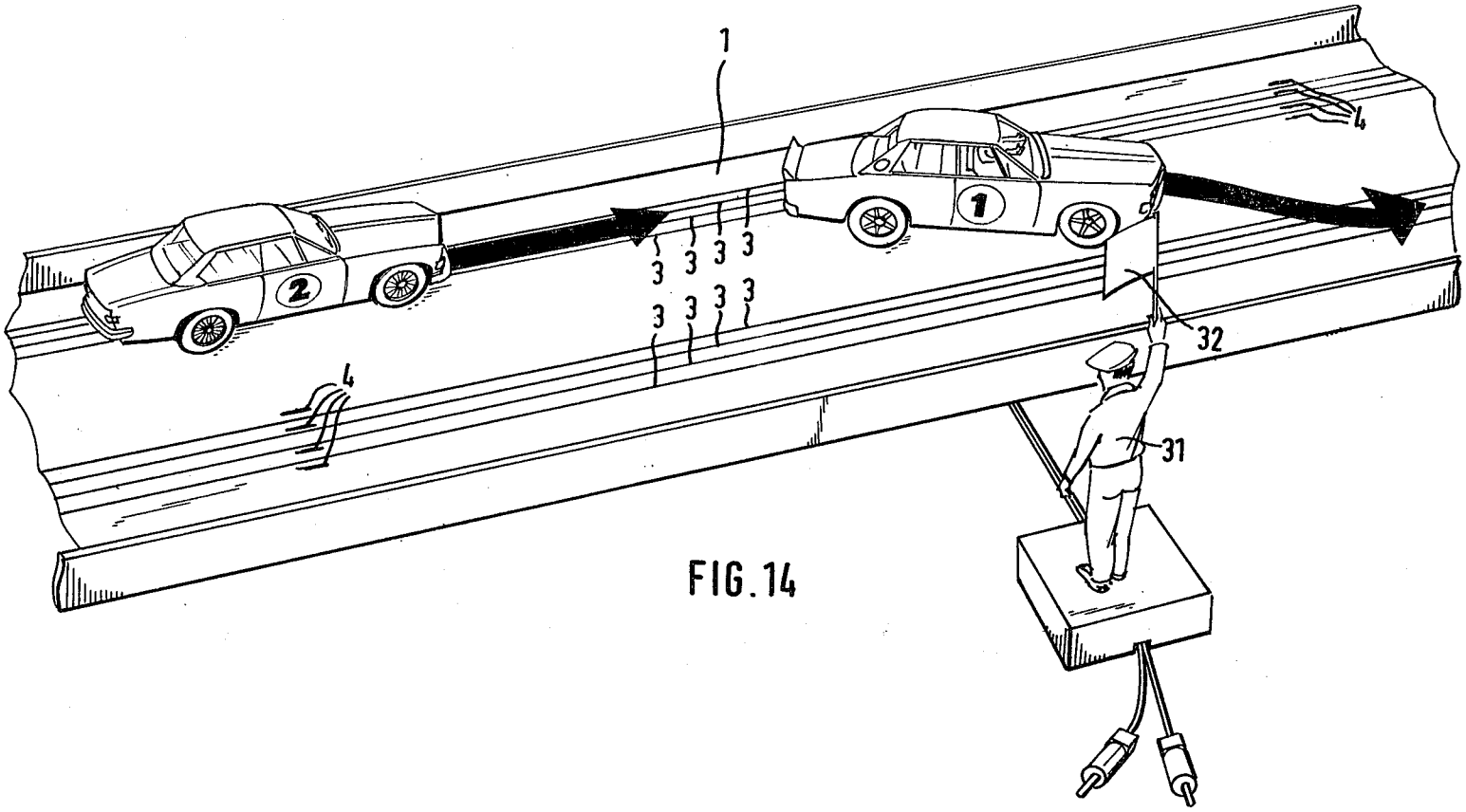

In FIG. 14 there is again represented the FIG. 31 with flag 32. Contact elements 4 are present which assume the detection of the vehicles. The driving position of the vehicles corresponds to that of the switching in of the sign "constricted location". The description of the circuitry is effected with FIG. 19.

Figure 15:
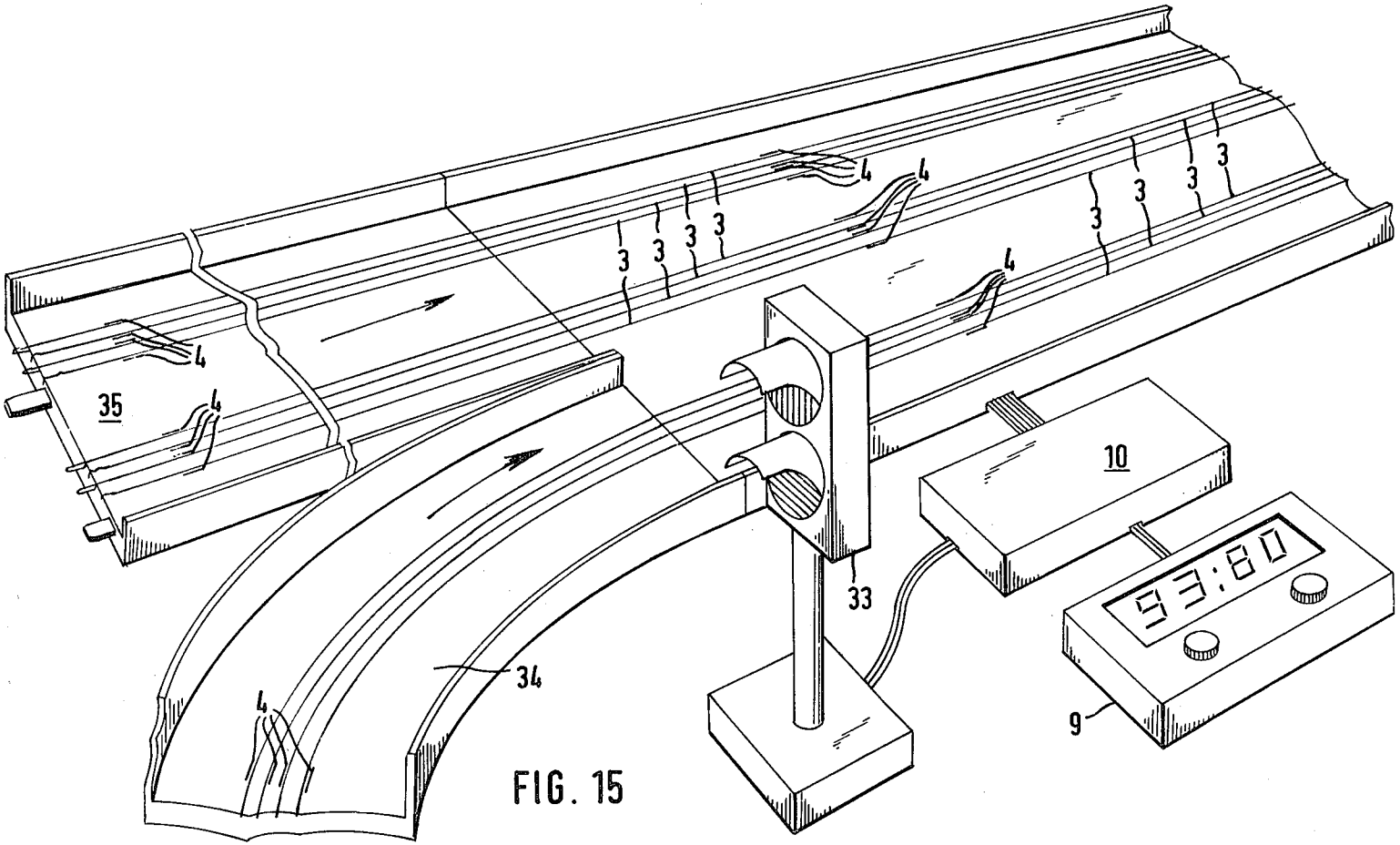

In FIG. 15 there is illustrated a traffic light 33. This light is connected to the switching apparatus 10. The detection of the vehicles is effected through the contact elements 4. When the traffic light 33 is switched to red, then those who are waiting to turn in from the track branch section 34 must wait. At driving over the subsequent contact section through a red light there is then recorded a penalty point.

The traffic light can also be switched by means of a vehicle which is located in a previously approved track section 35. As soon as the vehicle drives therein the traffic light is switched to red whereby those exiting from the track branch section 34 must wait.

Figure 16:
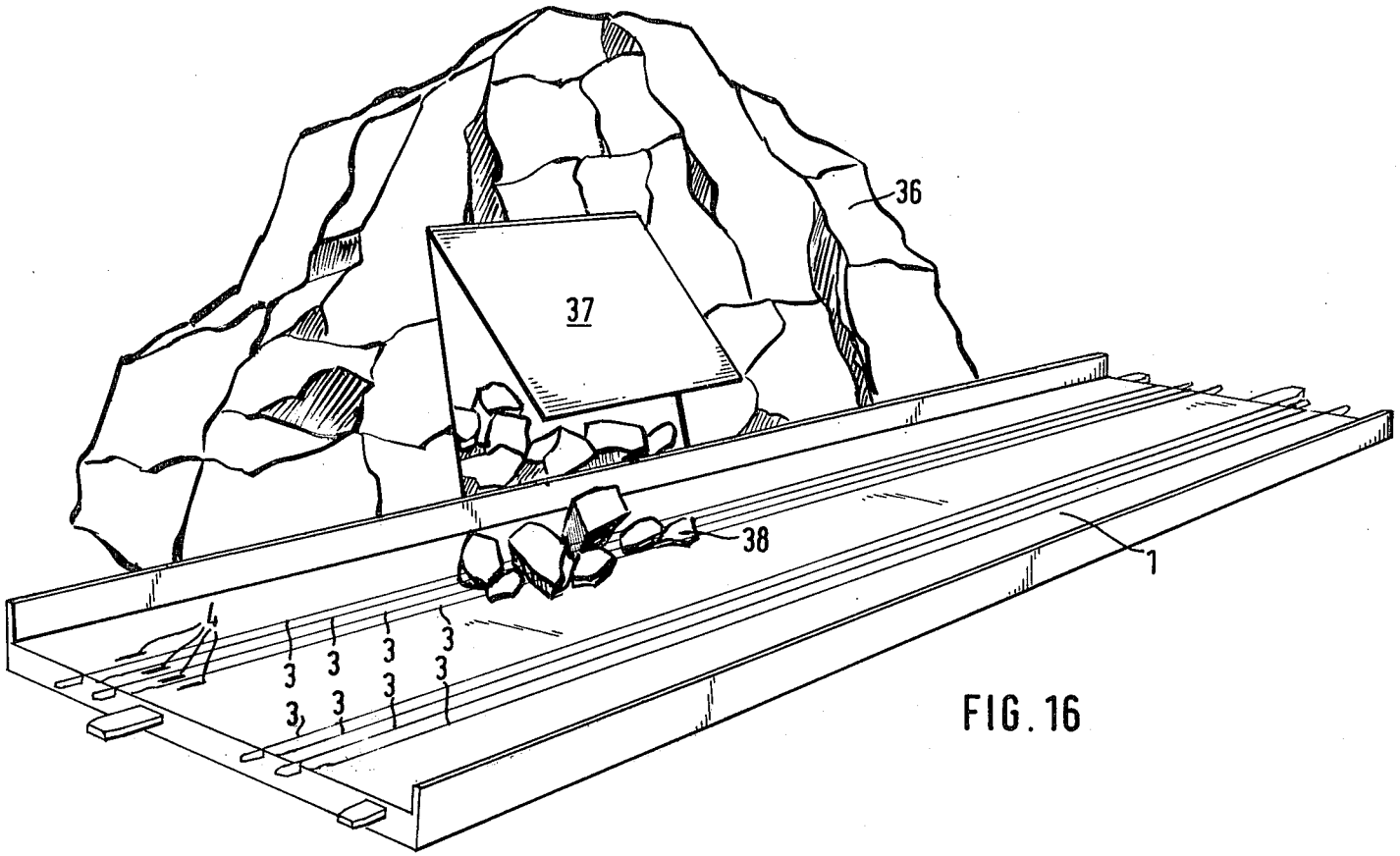

In FIG. 16 there is illustrated a terrain section 36. This possesses an opening 37 which is operated electromechanically. There follows a connection with a switching apparatus which causes the raising of the opening or door 37. Thereafter, particles 38, for example, styrofoam, can drop onto the track and force the vehicle to deviate. Driving over the contact elements 4 produces a penalty point.

Figure 17:
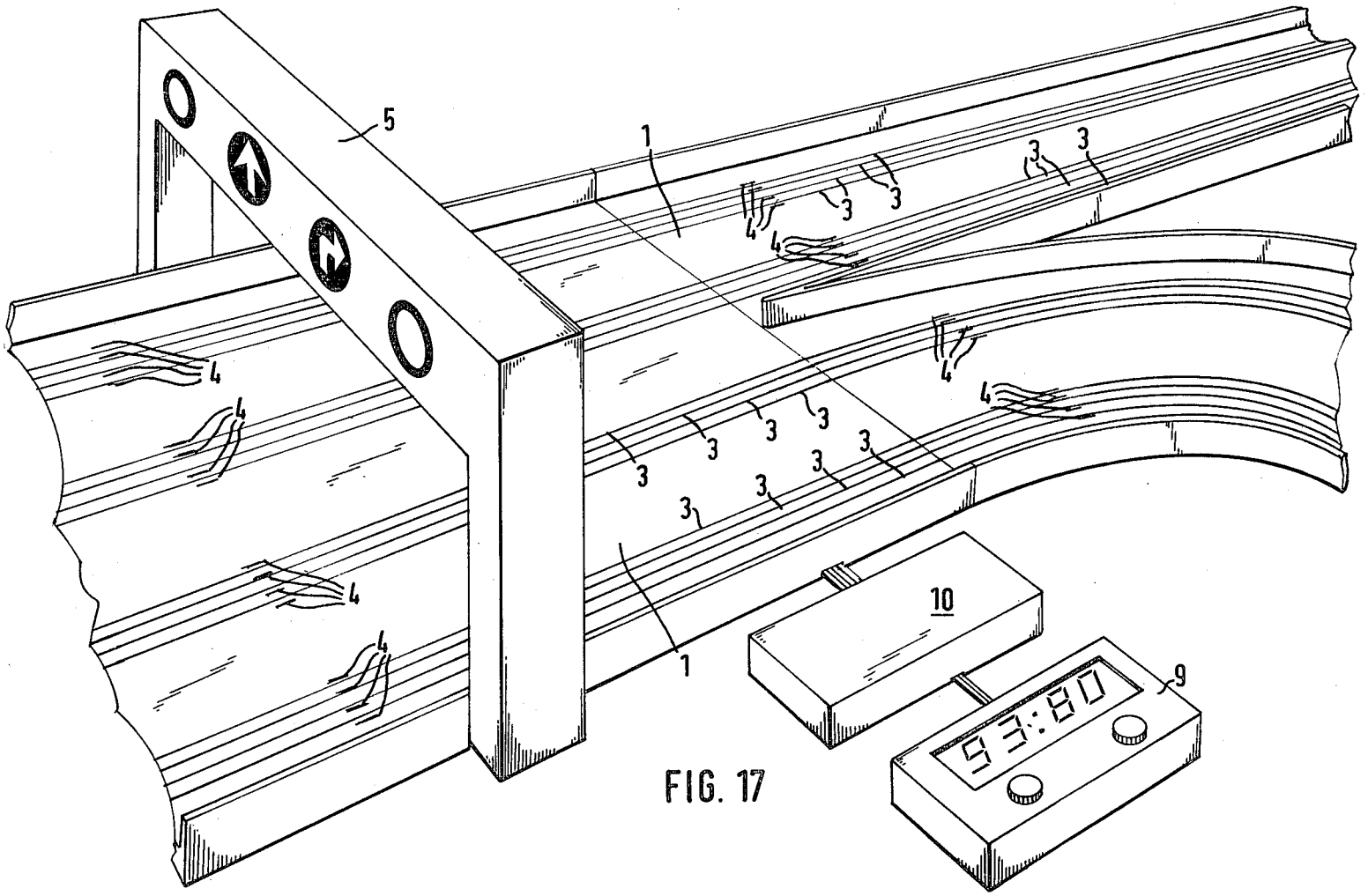

Illustrated in FIG. 17 is a track branch line. The vehicles are recorded through contact elements 4. Prescribed through a switching apparatus is the driving direction which the vehicles must assume.

The switching apparatus which is to be utilized pursuant to the described figures relates to a switching apparatus with operating panel and display 6 (FIGS. 1 and 2), or a stepping mechanism 11 (FIGS. 5 through 9), or to the electronic input unit 30 (FIG. 11).

Figure 18:
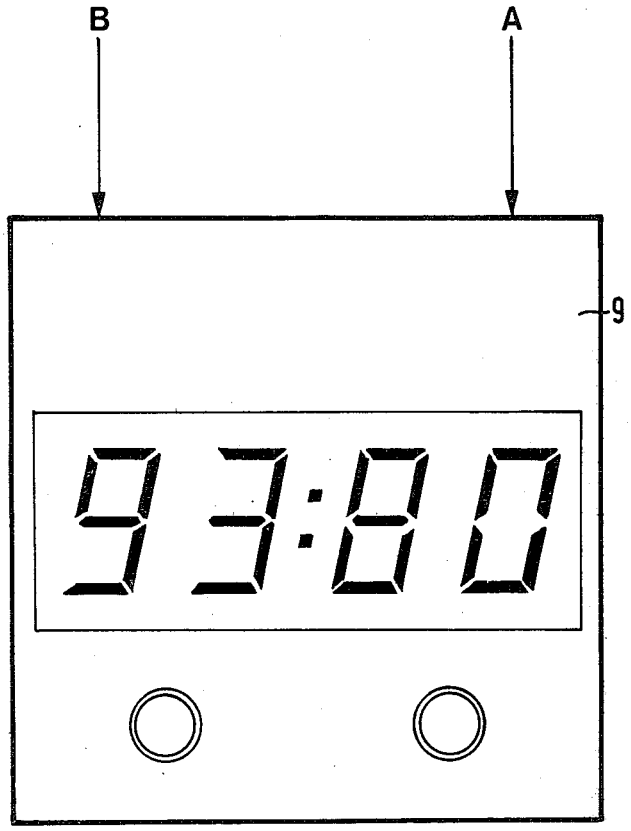
FIG. 18 illustrates the display 9.

FIG. 18 illustrates the display 9. Utilized for each track section is a two-column 7-segment LED display. Display 9 is used to display the total number of penalty points received by a particular vehicle throughout a race. As is described herein, penalty points are received when a vehicle does not follow the prescribed course as set by the switching apparatus which can be either an operating panel 6, stepping mechanism 11, or electronic unit 30.

Moreover, there can be recognized if a vehicle has or has not changed tracks within the measuring track section of the race track. Pursuant to a preselected play variant there is determined in the electronic circuitry as to whether the vehicle conform to the corresponding restrictions.

In the event that this is not the case, there then appears an impulse at the output of the evaluating electronic circuit, which is recorded in an electronic impulse counter and which increases by one in the display 9 the readable penalty points of the drivers A or B.

FIG. 4 illustrates the track section 1 with the current rails 3 and the contact elements 4. The contact elements 4 which are arranged on the track are bridged over the sliding contacts of the steered vehicles through the drive motor. The vehicle with the wider sliding contact distance bridges over only the two outer contacts, the other vehicle with the narrower sliding contact distance bridges over the two inner contacts. Thereby, is recognized as to which vehicle has traveled over what portion of the track section. Located between the sensors in the track section and the outputs AIL,BIL,AIR,BIR-,AOL,BOL,AOL, BOR are impulse forming steps which form clean and clear impulses from the scattered scanning impulses.

AIL signifies an input signal (input) on the left track side from vehicle A.

BOR is an output impulse (output) on the right track side from vehicle B.

In the arrangement pursuant to FIG. 19 the generated impulses are evaluated in accordance with the play variant.

1. Constricted location left with prohibition on passing (switches 100 and 101 set in the lower position).

All vehicles must travel within the measuring path on the right side of the track. When this requirement is not maintained, there is then issued a penalty point. When vehicle A drives right into the measuring path, in which the measuring path curves towards the left and does not touch the second right contact segment, the following then takes place:

On the conductor AIR there appears an impulse of driving in whereas the driving out impulse remains omitted from the conductor AOR. Thus, the start-stop generator 84 is started but is not reset due to the lack of driving out impulse, thereby there is recognized from a time comparison stage 93, which is constructed with a monoflop, that the vehicle has not traveled within the time determined within the stage 93 to correspond to the time required to generate a driving out impulse. In this instance, an impulse is emitted at the output of the stage 93 which, on the one hand, will through the output A, be conducted to the counter for the penalty points the total number of penalty points being displayed on display 9 while the start-stop generators 81, 82, 83 and 84 are again reset and thus again rendered "sharp" for the next lap. Since the driving over of the prohibited track (here on the left) is subject to a penalty point, through switch 110 the input AIR is additionally connected with the penalty point counter.

This means that in the track section 1, as shown in FIG. 1, each vehicle can produce four different pulses which can be evaluated, namely a starting pulse on the right race track (AIR, BIR) or a starting pulse on the left race track (AIL,BIL) and a stopping pulse on the right race track (AOR,BOR) or a stopping pulse on the left race track, (AOL,BOL). The circuit of FIG. 19 then evaluates whether the respective vehicle has generated the prescribed pulses within the prescribed time as required by the respective traffic regulation. As examples of typical traffic conditions see FIGS. 13 through 16. In order to evaluate the input and output impulses the individual start-stop-generators 81–84 and 85–88 can each receive two of the input pulses and generate independent thereof an output pulse, which corresponds to the distance of the two input pulses. But only one of these start-stop generators will receive both input pulses and can generate the output pulse. Independent of the respectively valid traffic regulation set by the switches 100–113, the output pulse generated by one of the start-stop generators is supplied to a time comparator 89,90,93 for the vehicle A and 91,92,94 for the vehicle B, and can then be compared to a pulse having a predetermined length.

If this traffic regulation is a speed limit, an exceeded speed limit is determined when the output pulse of the start-stop generator is shorter than the allowed pulse, and a corresponding pulse for producing an error point at the output of either vehicle A or B is delivered. If the traffic regulation is a rack track narrowing, it is determined whether the one vehicle has made the required track change, or whether the other vehicle has not made a track change.

The start-stop generator is set by the starting pulse generated at the entry end of the control segment, in particular by the positive leading edge, through which the output signal of this generator causes a level change for instance from low to high. Through this same edge of the stopping pulse arriving at a later time, the generator is reset whereby the output signal of the generator returns to low. The pulse length of the output signal of the generator created this way corresponds exactly to the time the respective vehicle needed from the entry until the exit of the control segment.

If no exit or stopping pulse is generated, as in the case of non-observance of the traffic regulation, the generator would not be reset, and this is why in a following driving process on the same track segment, for instance in the following lap, a newly generated starting pulse could no longer influence the generator, and so there would be no evaluation. This is the reason why the generator must be reset even if there is no stopping pulse. This resetting takes place via output signals of the time comparators, which feed back the reset pulses for the generators to these. The above-mentioned description is also applicable to the vehicle B which has a corresponding time comparator 94.

2. Constricted location right with prohibition on passing (switches 100 and 101 sliding contact upper).

Here all vehicles must drive within the detecting track section on the left side of the track.

This condition is the typical condition as shown in FIG. 13.

The detection is effected as in 1, however, through the start-stop generators 83 for vehicle A, and 85 for vehicle B.

3. Highest speed 60 kilometers per hour (switches 102 and 103 in).

In the event that, for example vehicle A drives through the measuring track section 2 too rapidly, an impulse is generated in the start-stop generator 83 which is shorter than that generated by the comparator impulse generator 89. Through the time comparison in 89 this is recognized and an impulse emitted at the output which is conducted to the penalty point counter through the output A.

4. Highest speed 130 kilometers per hour (switches 104 and 105 in).

Here the start-stop impulse is compared with the comparator impulse generator 90 for vehicle A and 92 for vehicle B. If the start-stop impulse is shorter, then this corresponds to a speed higher than permissible, and at the output there is again produced a penalty point.

The start-stop generator 81 or 88 then determines the through traveling speed when the vehicle A or B has changed the track within the measuring section. These times are again compared with the corresponding comparative impulses for 60 or 130 kilometers per hour.

The inputs A and B are conducted to an impulse counter which concurrently shows the number of penalty points for vehicle A and vehicle B on a display 9.

Moreover, the outputs of the switches 114 and 119 are conducted to the bridge whereby presently effective restriction or permission shields are illuminated by means of lamps 150 through 157.

Figure 20:
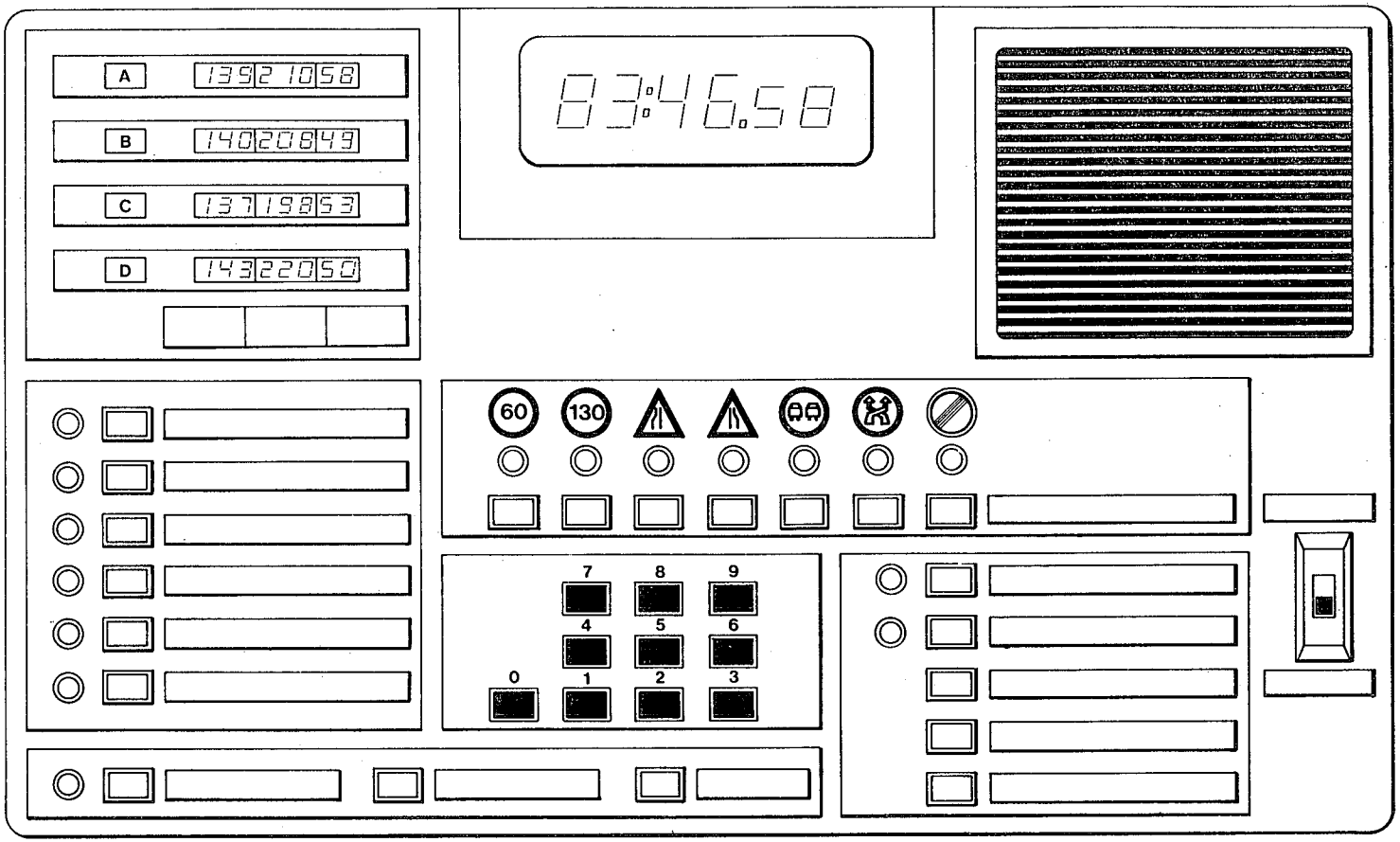
FIG. 20 illustrates the upper portion of a housing.

Illustrated in FIG. 20 is also an upper housing portion in which there are combined in one housing component the switching apparatus 10, the display 9 and the electronic input unit 30.

The function and manner of servicing corresponds to that illustrated with the distinction that different individual housings are not utilized.

What is claimed is:

1. In a game apparatus with toy vehicles adapted to run on a track, said vehicles being electrically identified with contact segments being located in said track and bridging contacts being provided on said vehicles whereby electrical contact with said contact segments is made the improvement comprising: at least one pair of said contact segments being arranged pair-wise so that upon the passage of a vehicle over the first contact segment there is generated a starting impulse and upon the passage of the said vehicle over the second contact segment there is generated a stop impulse; a start-stop generator means associated with each said pair of contact segments to receive both said start and stop impulses therefrom and said generator emitting an impulse the length of which corresponds to a time interval between said start and stop impulses; at least one time comparator stage being connected to the output of said start-stop generator means and said comparator emitting an output impulse if the length of the impulse received from said start-stop generator means exceeds a predetermined length as set by a desired game variant, and a counter means receiving said output from said time comparator stage.

2. Game apparatus as claimed in claim 1, comprising counter means connected to the outputs of said time comparator stages.

3. Game apparatus as claimed in claim 1, the output of one said time comparator stage being connected to an input of an associated start-stop generator means.

4. Game apparatus as claimed in claim 3, the output of one said time comparator stage being connected to a reset input of an associated start-stop generator means.

5. Game apparatus as claimed in claim 1, the pairwise arrangements of said contact segments being variable.

6. Game apparatus as claimed in claim 1, the presently pairwise arrangement of said contact segments representing a predetermined driving requirement for said vehicles.

7. Game apparatus as claimed in claim 1, comprising at least one change-over switch connecting the output of a start-stop generator means with said time comparator stages.

8. Game apparatus as claimed in claim 3 or 4, comprising switch means connecting the output of said time comparator stages with the inputs of said start-stop generator means.

9. Game apparatus as claimed in claim 7, wherein the position of said change-over switch represents a predetermined driving requirement.

10. Game apparatus as claimed in claim 7, said switches being electronic switches.

11. Game apparatus as claimed in claim 7, said switches being actuatable through push buttons.

12. Game apparatus as claimed in claim 7, said switches being actuatable through an electronic input unit.

13. Game apparatus as claimed in claim 7, said switches being actuatable through at least one stepping mechanism.

14. Game apparatus as claimed in claim 11, comprising further switches actuatable through said push buttons for effecting a display of the prescribed driving requirements.

15. Game apparatus as claimed in claim 12, comprising further switches actuatable through said electronic input unit for effecting a display of the prescribed driving requirements.

16. Game apparatus as claimed in claim 13, comprising further switches actuatable through said stepping mechanisms for effecting a display of the prescribed driving requirements.

17. Game apparatus as claimed in claim 11 or 12 or 13, comprising further switches actuatable for selectively actuating a traffic light, a figure with a movable flag, and a trap door arranged proximate said track.

18. Game apparatus as claimed in claim 1, comprising a display arrangement extending over said track and having symbols therein illustrative of the presently effective drive requirements.

19. Game apparatus as claimed in claim 18, said display arrangement including illuminated signs.

20. Game apparatus as claimed in claim 13 or 16, comprising a unitarily constructed switch roller forming said stepping mechanism, said mechanism being removable from said apparatus through the pivoting out of a complimentary support from a retainer.

21. Game apparatus as claimed in claim 20, said switch roller comprising individual cam discs having switch cams acting on contacts; a spiral spring pressing said switch cams, said switch cams being mutually displaceable through a toothed device located on both sides thereof.

22. Game apparatus as claimed in claim 21, comprising push buttons being arranged in a housing of said stepping mechanism for effecting a manual switching in and switching out of the driving requirements when said stepping mechanism is disconnected, and effecting a switching out through a switch upon said stepping mechanism being connected so as to prevent a driving requirement from being applied even during actuation of the contact or the switch cams.

23. Game apparatus as claimed in claim 1, said vehicle including a bridging contact of a configuration specific to the vehicle.

24. Game apparatus as claimed in claim 23, wherein said bridging contact evidences a distance specific to the size of the vehicle.

* * * * *